US008228264B2

(12) United States Patent
Ng et al.

(10) Patent No.: US 8,228,264 B2
(45) Date of Patent: Jul. 24, 2012

(54) SEGMENT DRIVING METHOD AND SYSTEM FOR A BISTABLE DISPLAY

(75) Inventors: Chi Wai Ng, Tseun Wan (HK); Siu Kei Wong, Hong Kong (HK); Wai Hon Ng, Hong Kong (HK); Man Chun Wong, Hong Kong (HK); Jimmy Chiu, Shatin (HK)

(73) Assignee: Solomon Systech Limited, Shatin, N.T. (HK)

( * ) Notice: Subject to any disclaimer, the term of this patent is extended or adjusted under 35 U.S.C. 154(b) by 1111 days.

(21) Appl. No.: 11/727,778

(22) Filed: Mar. 28, 2007

(65) Prior Publication Data

US 2008/0238894 A1 Oct. 2, 2008

(51) Int. Cl.
*G09G 3/04* (2006.01)

(52) U.S. Cl. ..... 345/33

(58) Field of Classification Search ..... 345/33–54, 345/107

See application file for complete search history.

(56) References Cited

U.S. PATENT DOCUMENTS 4,224,617 A * 9/1980 Stein ..... 345/53
4,277,786 A * 7/1981 Waldron ..... 345/53
5,066,946 A * 11/1991 Disanto et al. ..... 345/107
5,155,476 A * 10/1992 Shioji ..... 345/50
7,042,203 B2 5/2006 Van Der Horn et al.

OTHER PUBLICATIONS

Kurt Muhlemann, "A 30-V Row/Column Driver for Flat-Panel Liquid Crystal Displays," IEEE Journal of Solid-State Circuits, vol. 23, No. 2, Apr. 1988.

Alfred Poor, "What's New With Displays," http://www.pcmag.com/print_article2/0,1217,a=124171.00.asp May 4, 2004.

http://www.cknow.com/ckinfo/b/BistableDisplay-Astabledi.html, Mar. 16, 2007.

* cited by examiner

*Primary Examiner* — Sumati Lefkowitz
*Assistant Examiner* — Robert E Carter, III
(74) *Attorney, Agent, or Firm* — Finnegan, Henderson, Farabow, Garrett & Dunner, LLP

(57) ABSTRACT

Method and apparatus are provided for driving segments of a bistable display. The method may include providing, at the same time, a plurality of independent waveforms corresponding to display data for driving a plurality of segments of the display. The method may include selecting, for each segment, one of the independent driving waveforms. The method may also include determining whether an update of display data has occurred for one of the segments. The method may include selecting a different one of the waveforms to drive the segment if an update has occurred. The method may further include maintaining a currently selected waveform to drive the segment if an update has not occurred.

12 Claims, 9 Drawing Sheets

SEGMENT DRIVING METHOD AND SYSTEM FOR A BISTABLE DISPLAY

TECHNICAL FIELD

The present invention generally relates to a method and system for driving a display panel. More particularly, the present invention relates to a method and system for driving segments of a bistable display.

BACKGROUND

Panel displays are commonly used in electronic products. It is known to provide panel displays based on electrophoretic effects. Electrophoretic effects comprise charged particles dispersed in a fluid or liquid medium moving under the influence of an electric field. As an example of the application of electrophoretic effects, displays may use charged pigment particles dispersed and contained in a dye solution and arranged between a pair of display electrodes. The dye solution in which charged pigment particles are dispersed is known as "electrophoretic ink" or "electronic ink." A display using electrophoretic ink is known as an electrophoretic display ("EPD"). Under the influence of an electric field, the charged pigment particles are attracted to one of the pair of display electrodes. In response, desired images are displayed.

In recent years, EPD technology has been introduced for use in flat panel displays. FIGS. 1A and 1B illustrate this technology using microcapsules filled with electrically charged white particles suspended in a pigmented oil. For example, FIG. 1A illustrates one implementation in which the underlying circuitry controls whether white particles are at the top or bottom of the capsule. In this example, if the white particles are at the top of the capsule, the display appears white to the viewer. On the other hand, if the white particles are at the bottom of the capsule, the viewer sees the color of the oil, as illustrated in FIG. 1B. As a result, the use of microcapsules allows the display to be constructed using flexible plastic sheets, as well as glass.

One feature of EPD technology is that the pixels are bistable. That is, the pixels can be maintained in either of two states without a constant supply of power. Another feature of EPD technology is that particles in an EPD panel move in different directions according to control voltages, in order to display different colors. As a result, EPD panels have a response time which is slower than those of other types of flat panel display.

One application of EPD technology, the electronic paper display device, is being developed as a next generation display device to replace liquid crystal display devices, plasma display panels, and organic electro-luminescent display panels. In particular, electronic paper display panels using "electronic ink" are expected to be a replacement, in certain applications, for existing print media such as books, newspapers, magazines, or the like. E Ink Corporation is an example of a company active in development of such displays.

The electronic paper display device is well suited for use as a flexible display device because the device can be constructed to include a flexible substrate. For example, an electronic paper display device constructed to include a substrate of flexible material, may have advantages in terms of flexibility, simplicity, and reliability. Development of the electronic paper display device may also lead to construction of paper-thin reflective displays without use of a backlight, resulting in very low power consumption.

More generally, however, available methods for driving EPD panels have a relatively long response time. For example, data is displayed depending on the motion of particles. As a result, it is not suitable for displaying images that embody moving images. Also, EPD panels also have limitations in representing full color and gradation.

Another difficulty in the application of EPD technology is that the driving schemes used with traditional flat display panels, such as liquid crystal displays (LCD), do not produce the same performance when applied to drive an EPD. Two reasons for this are described below.

First, EPD and LCD applications have respectively different display response times. For example, when a display panel displays video (i.e., moving) images, the pixel data of different image frames change at a rate of tens of times per minute. In this condition, the brightness of pixels is controlled by a driving circuit, by changing levels of the driving voltages applied to the pixels. There is a time period for the driving circuit to hold the levels of the driving voltage. In LCD display applications, the driving circuit is required to hold the levels of the driving voltages over a time period in the range of 10 ms, depending on display resolution and frame frequency. However, the hold time required by the EPD is relatively an order of magnitude longer than that required for a traditional display panel, such as LCD.

Second, because EPD applications have a much longer response time, an EPD may have a pixel layout and driving methods different from those implemented for a traditional flat display panel, such as the LCD. In an LCD application, pixels are arranged in rows and columns. This arrangement is known as a dot-matrix pixel layout. Each and every row or column is activated sequentially. That is, the rows or columns are activated one at a time, in a scanning manner. Each pixel in a row or column has its own electrode for receiving a driving voltage. When each row or column is activated, all pixels present in the row or column are updated by the same control unit. Display apparatuses for driving displays with the dot-matrix pixel layout are divided into two types: passive matrix (PM) type and active-matrix (AM) type.

In the passive matrix (PM) display, a matrix of electrically-conducting columns and rows are orthogonally arranged to form a two-dimensional array of picture elements, i.e., pixels. Positioned between the orthogonal column and row lines, thin films of display material are activated to display black or white colors. This is achieved by applying electrical signals directly to the designated rows and columns.

In contrast, an AM display panel, consists of display pixels that have been deposited or integrated with a thin film transistor (TFT) array to form a matrix of pixels that displays images upon electrical activation. A TFT backplane acts as an array of switches that control the connection of applied image signals to each pixel. The TFT array continuously determines if and when signals are applied to the pixels, resulting in a scan of all pixels and in display of a corresponding image on a panel.

FIG. 2 is a schematic view depicting display driving electronics system for an AM TFT LCD 208 with K columns by L rows. As shown in the figure, if there are K pixels located in the horizontal direction, K channels of source drive units (SDUs) 202 are required for driving K columns of pixels of the LCD 200. In the vertical direction, a gate driver 206 is employed to drive a voltage on each of L scanning lines sequentially, to turn on and off TFT's 208 of the pixels on each row for sampling and holding the voltage level outputted by the SDU's 202. As a result, each row is activated sequentially by the gate driver 206 in repeated scanning cycles.

For both AM and PM type displays, in order to display a full image, each row of the display must be updated in 1/N of the frame time needed to scan the entire display, where N is the number of rows in the display. For example, in order to achieve a 220-row display image, the pixels must be driven to the required color in 1/220 of the entire frame time. The scanning speed must be sufficiently fast, such that the sequentially activated elements appear to the human eye as being activated simultaneously, thus allowing for a proper and consistent image, as perceived by the user. However, this requires an updating time for a single row in the range of 75 μs with a frame frequency of 60 Hz. Characteristics of the LCD panel enable such fast display-updating speed. However, because EPD applications require a much longer response time in order to update a pixel (which may be as long as seconds), the above scanning scheme may lead to a very slow image refresh rate for EPD applications. This disadvantage may lead to a non-user-friendly interface in applications including or requiring interaction between a user and a driver IC.

An example of a scan-driving PM-type EPD is described in U.S. Pat. No. 4,947,157 to Di Santo et al. ("Di Santo"). Di Santo discloses a driving apparatus for an electrophoretic display. FIG. 1 of Di Santo is reproduced herein as FIG. 3A. With reference to FIG. 3A, the display of Di Santo includes a cathode electrode 11, which is one of a series of lines arranged in a horizontal X direction. Associated grid lines 12 appear to run in the Y direction and are insulated from the cathode electrode 11 by insulating layer 13. The cathode electrodes 11 and the gridlines 12 form an X-Y matrix. An anode electrode 15 overlies an electrophoretic dispersion 16 between the cathode electrode 11 and anode electrode 15 and contains a plurality of submicron pigment particles. When a potential is applied between an X and Y point indicative of a pixel accelerating particles (e.g., particles 17 and 18), in the vicinity toward the anode where they remain until bias is reversed.

As shown in FIG. 3B, Di Santo discloses the X-Y matrix consists of the cathode lines which are arranged in the horizontal plane and the grid lines which are perpendicular to the cathode lines and which are insulated from one another. Each cathode line has a suitable driving amplifier circuit shown in modular form and indicated by reference numerals 40, 41, 42, and 43. Each grid line has a suitable driving amplifier referenced by modules 50, 51, 52, and 53. The driving signals for the grid and cathode lines are obtained by X-driving generator 60 and Y-driving generator 61. In a display data write mode, pixels are updated row by row. The cathode lines which have pixels to be written are placed at zero potential, one by one, in a line-scanning scheme while non-writing cathode lines are placed at positive voltage (potential). When a cathode line is selected, writing grid lines are operated at a high potential and non-writing grid lines are operated at the low or zero potential. As a result, pixels are updated row by row.

For example, in order to update pixels 70 and 80 in FIG. 3B, cathode line 20 is set to zero potential while other cathode lines are kept at a positive potential. Pixel 70 is then updated by applying a positive voltage (potential) to the corresponding grid line 30 while applying a low or zero potential to other grid lines. After the updating of pixel 70 is finished, cathode line 23 is set to zero potential while other cathode lines are kept at a positive voltage (potential). Pixel 80 is then updated by applying a positive voltage to grid line 32, while applying a low or zero potential to other segment lines. This procedure is repeated until all rows are updated.

Although the scan-driving scheme of Di Santo achieves a high display resolution, it may result in a slow image-update speed. In order to refresh a display, the pixels in the array have to be updated row by row. Each and every row which has pixels to be updated is activated and updated sequentially, one at a time, in a scanning manner. When a row of pixels is selected to change or update data information, the update of this row cannot be initiated until the changes in a previous row have been completed. Therefore, the minimum refresh time required for a display in this scanning scheme is a product of the number of rows which have pixels to be updated, multiplied by the update time required for an individual pixel.

As a result, scan-driving type EPD may be an undesirable choice for applications requiring reliable human-machine interface, because the scan-driving type EPD responds slowly to user inputs. Furthermore, due to the slow image update speed, i.e., updating all pixels together in one row and having all pixels refreshed after one frame, in a prior art dot-matrix pixel layout arrangement, EPD applications cannot support high display resolution or motion-type image quality.

One possible solution for overcoming such shortcomings, when the EPD is used in applications that do not have many pixels but which require a real time response, is use of a segment drive (or direct drive) such that all pixels are updated at the same time. FIG. 4 illustrates a block diagram of a conventional display driving system in which all pixels are driven at the same time. As shown in FIG. 4, all pixels of a display panel 406 are controlled by a waveform generating unit 402 coupled to segment cells 404*a*, 404*b*, . . . , 404*m*, and are updated at the same time. Without the scanning process, the refresh time required for the display 406 is just the update time required for one pixel.

An example of a segment display driver is a 40 segment static LCD driver chip V6108 manufactured by EM Microelectronic. FIG. 5 is a block diagram of this driver. A 40 bit shift register and the 40 latches correspond to the waveform generating unit 402 of FIG. 4, while voltage level shifters LS correspond to the segment cells 404 of FIG. 4. Each LS drives a segment pixel, e.g., SEG 1-SEG 40 in the display panel 406. The latches update the output signals to all level shifters 40 LS at the same time under control of various signals.

However, use of a conventional segment display driver to drive an EPD panel may have disadvantages. For example, when a waveform is applied to update the display in an EPD panel, another update can only be initiated after the completion of the previous update for the entire display. Although the display refresh time has been decreased to only the update time of one pixel, it may still be as long as several seconds in some cases.

There are limitations on the use of a segment display driver. For example, all segment cells are driven to provide outputs waveforms at the same time and are fixed by design of the driver IC. Regardless of whether data is changed or whether only a single pixel needs to be updated, all segment cell units would accordingly output driving waveforms at a fixed time. Second, because of this limitation, programmers or users can only update data after a previous input has been displayed on the EPD panel. This limits flexibility, since it does not allow programmers or users to update data at different times or more arbitrarily.

One solution to such limitations is illustrated by a display segment driving system 600 shown in FIG. 6. In system 600, a separate waveform generating unit 602, e.g., 602*a*, 602*b*, . . . , 602*m*, is provided for each pixel. A separate segment cell 604, e.g., 604*a*, 604*b*, . . . , 604*m* is respectively provided for each generating unit 602. Each of the segment cells 604 are coupled to a display panel 606. However, because every pixel is driven by a separate waveform generator 602, the display update of a second input can be started immediately regardless of whether or not the display update of a previous input has been completed. Therefore, an instant display response can be achieved. However, such an arrangement requires a great amount of additional circuit area, which may not be feasible for certain applications.

While problems with driving bistable displays have been described with reference to EPD panels, bistable stable displays may be constructed using other technologies. For example, Nemoptic is an e-paper display company that develops bistable liquid crystal displays. The above described problems with driving bistable displays need to be addressed regardless of the technological basis for the bistable display's construction.

Thus, there is a need for a method and system directed to improving driving of a bistable display.

SUMMARY

Method and apparatus consistent with the present invention provide for driving a bistable display with driving control.

In one exemplary embodiment, there is provided a method for driving segments of a bistable display. The method may include providing, at the same time, a plurality of independent waveforms corresponding display data for driving a plurality of segments of the display. The method may also include selecting, for each segment, one of the independent driving waveforms. The method may include determining whether an update of display data has occurred for one of the segments. The method may further include selecting a different one of the waveforms to drive the segment if an update has occurred. The method may also include maintaining a currently selected waveform to drive the segment if an update has not occurred.

In another exemplary embodiment, there is provided a system for driving segments of a bistable display. The system may include a plurality of segment cells coupled to drive corresponding segments of the display panel. The system may also include a plurality of units for generating time-independent waveforms corresponding to display data for provision to the plurality of segment cells. The system may further include a plurality of segment control units coupled to corresponding ones of the plurality of segment cells, for selecting the waveform from one of the units for output to the corresponding segment cells; each of the segment control units including means for determining whether display data for the corresponding segment cell has changed and for selecting the waveform from a different one of the units if the display data has changed.

It is to be understood that both the foregoing general description and the following detailed description are exemplary and explanatory only and are not restrictive of the invention, as described. Further features and/or variations may be provided in addition to those set forth herein. For example, the present invention may be directed to various combinations and subcombinations of the disclosed features and/or combinations and subcombinations of several further features disclosed below in the detailed description.

BRIEF DESCRIPTION OF THE DRAWINGS

The accompanying drawings, which are incorporated in and constitute a part of this specification, show certain aspects of the present invention and, together with the description, help explain some of the principles associated with the invention. In the drawings, FIGS. 1A and 1B each illustrate a cross-section of a thin electrophoretic film in accordance with the prior art.

DETAILED DESCRIPTION

Reference will now be made in detail to the invention, examples of which are illustrated in the accompanying drawings. The implementations set forth in the following description do not represent all implementations consistent with the claimed invention. Instead, they are merely some examples consistent with certain aspects related to the invention. Wherever possible, the same reference numbers will be used throughout the drawings to refer to the same or like parts.

Figure 1A:
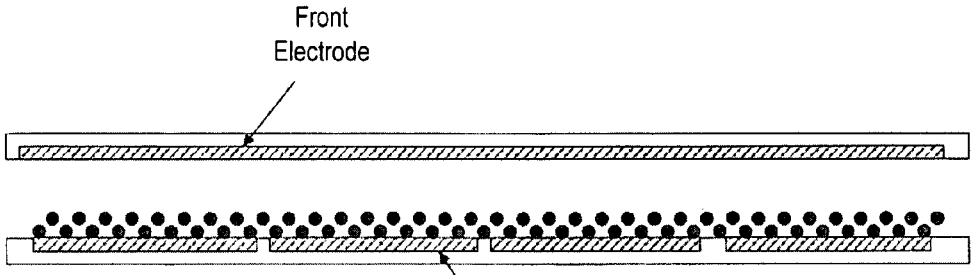
Figure 1A (Prior Art)
Figure 1B:
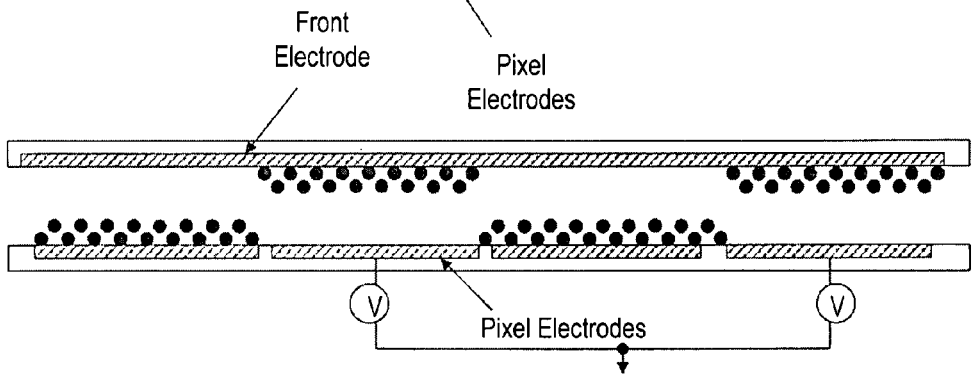
Figure 1B (Prior Art)
Figure 2:
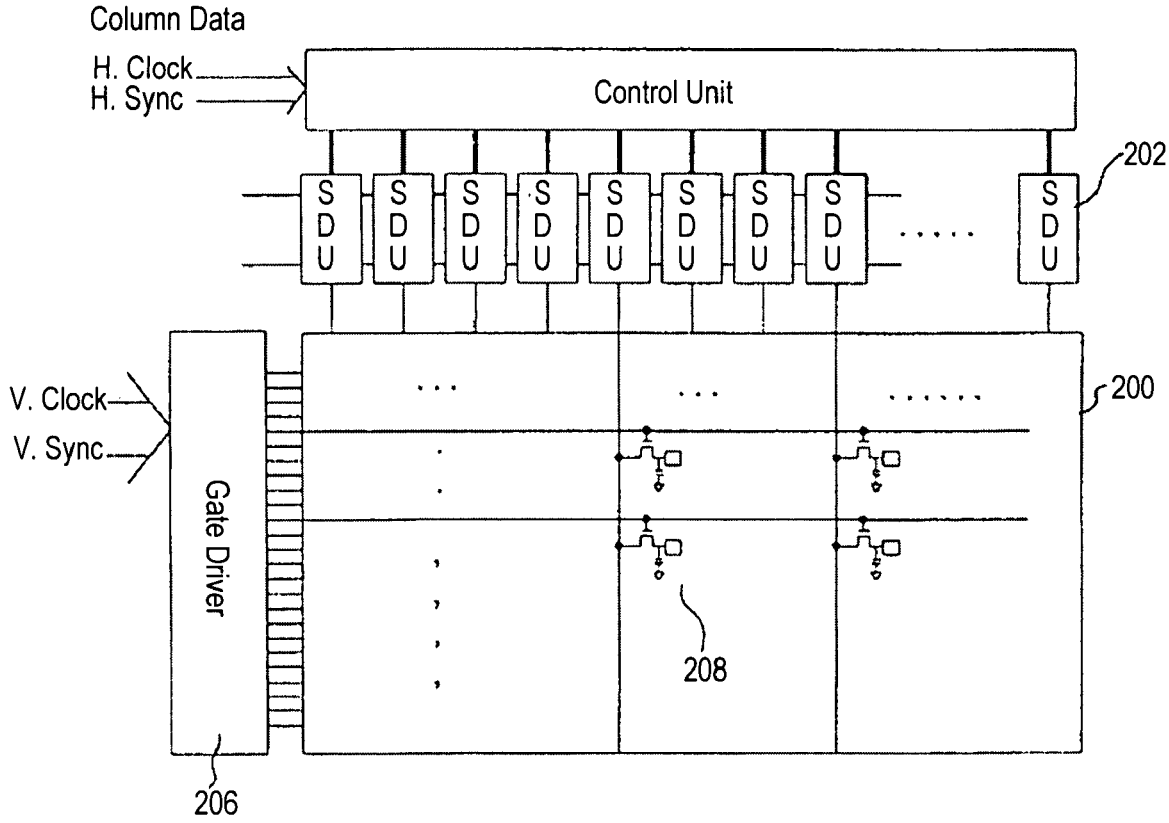
Figure 2 (Prior Art)
FIG. 2 illustrates a block diagram of a conventional AM type driving display system.
Figure 3A:
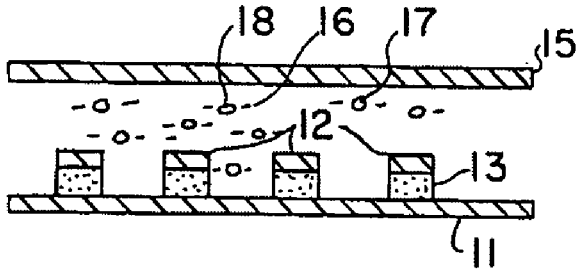
Figure 3A (Prior Art)
FIG. 3A illustrates a cross-section of a conventional EPD.
Figure 3B:
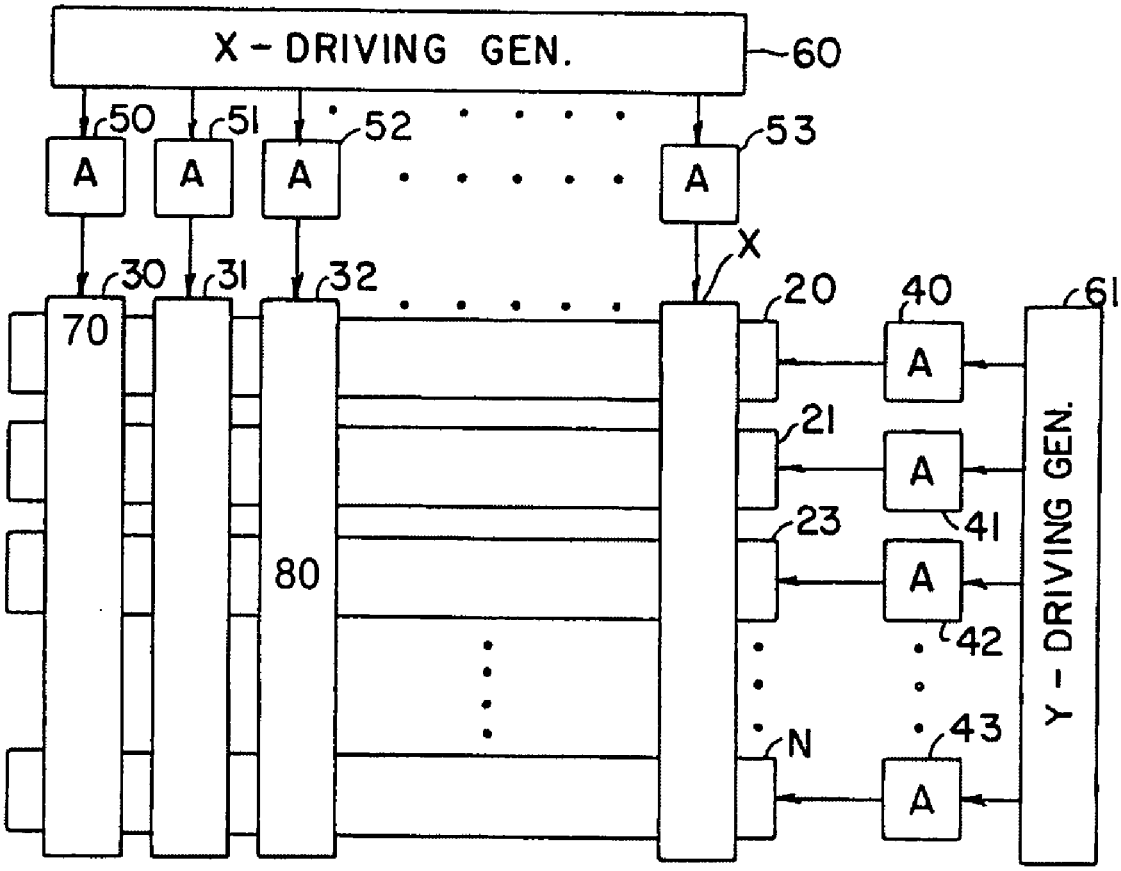
Figure 3B (Prior Art)
FIG. 3B illustrates a schematic view of a conventional driving system for an EPD.
Figure 4:
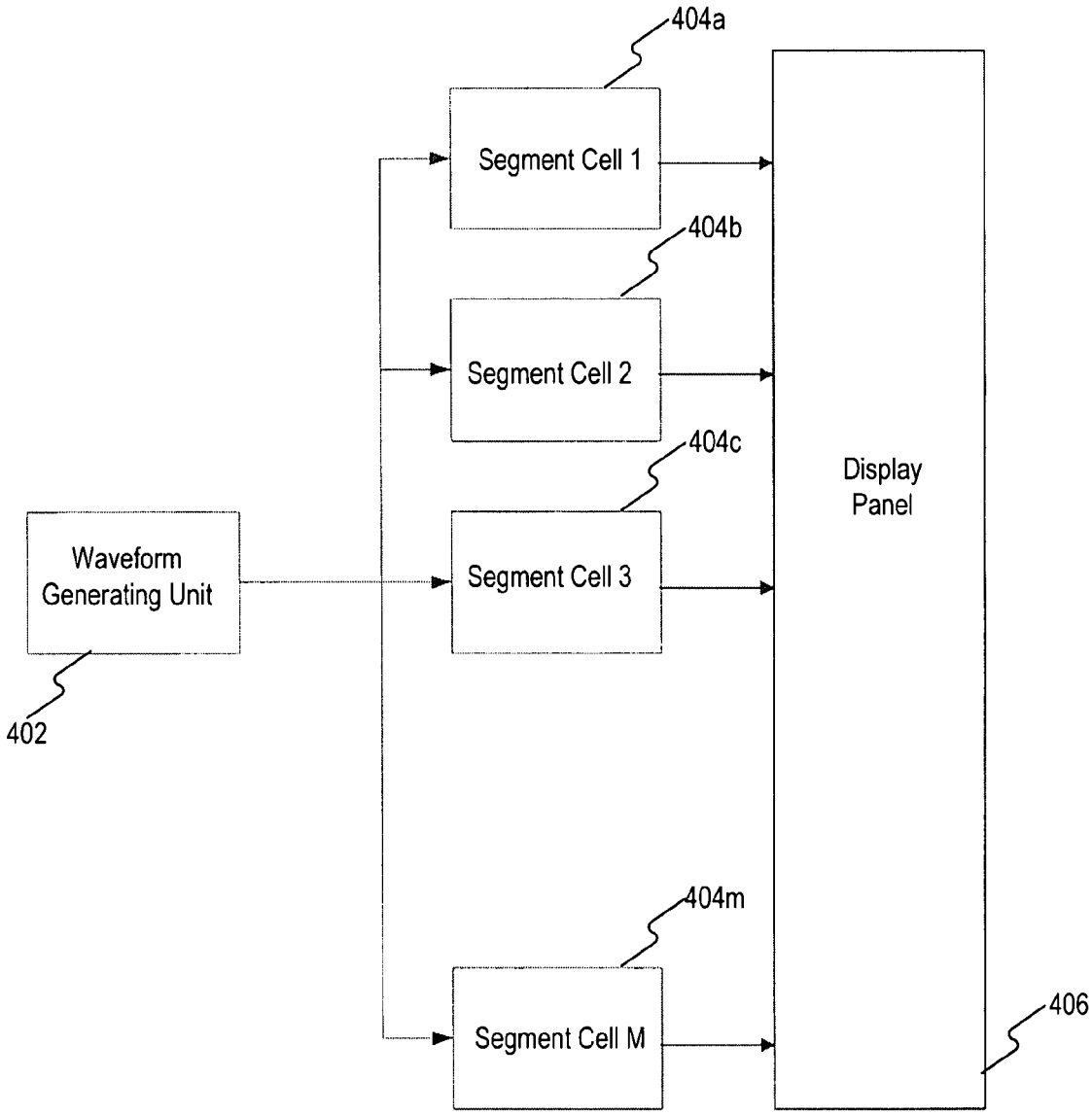
Figure 4 (Prior Art)
FIG. 4 illustrates a block diagram of a conventional display driving system in which all pixels are driven at the same time by a waveform generator.
Figure 5:
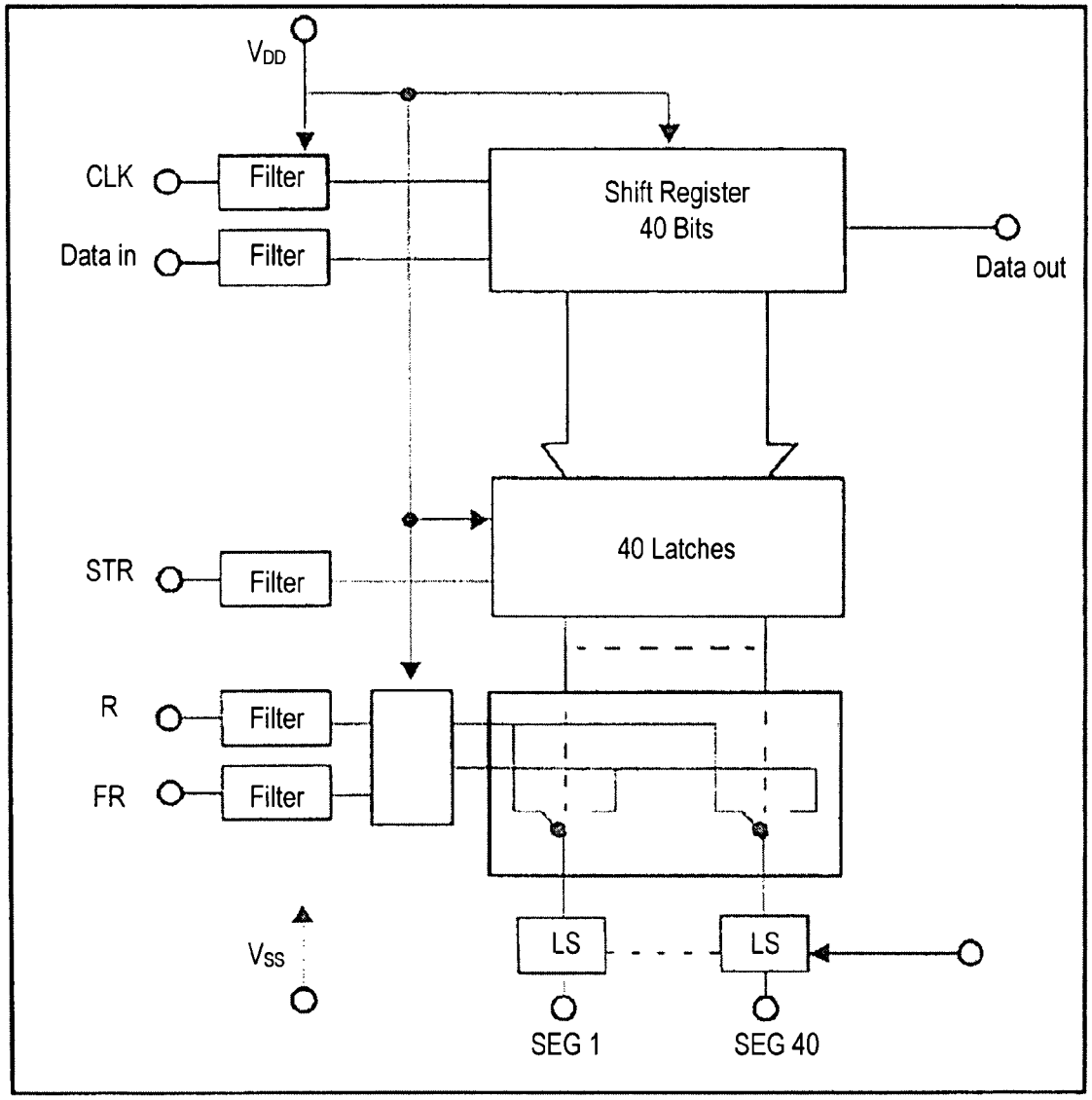
Figure 5 (Prior Art)
FIG. 5 illustrates a block diagram of a conventional segment LCD driver.
Figure 6:
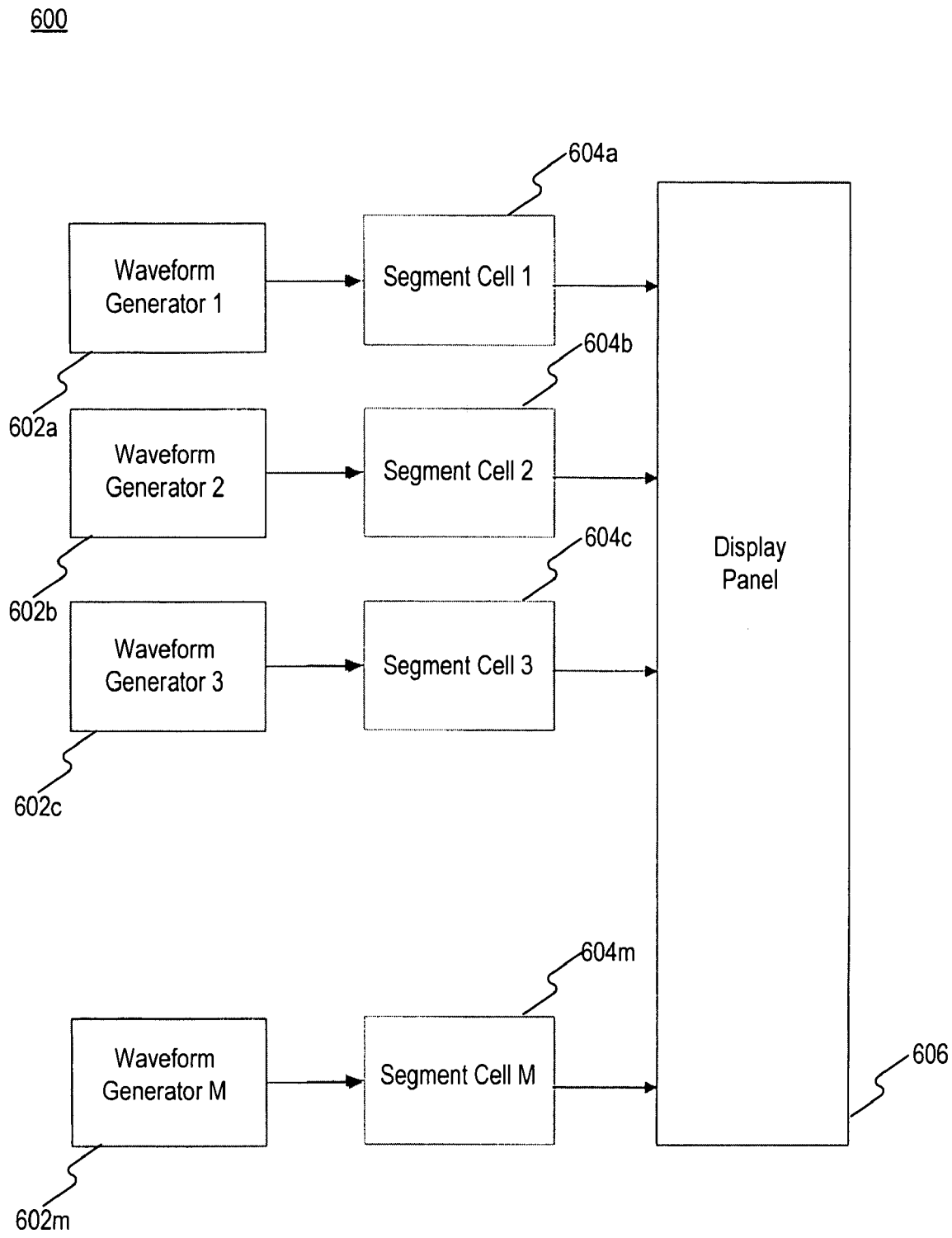
Figure 6 (Prior Art)
FIG. 6 illustrates the block diagram of a conventional driving display system in which all pixels are driven separately by individual generators.
Figure 7:
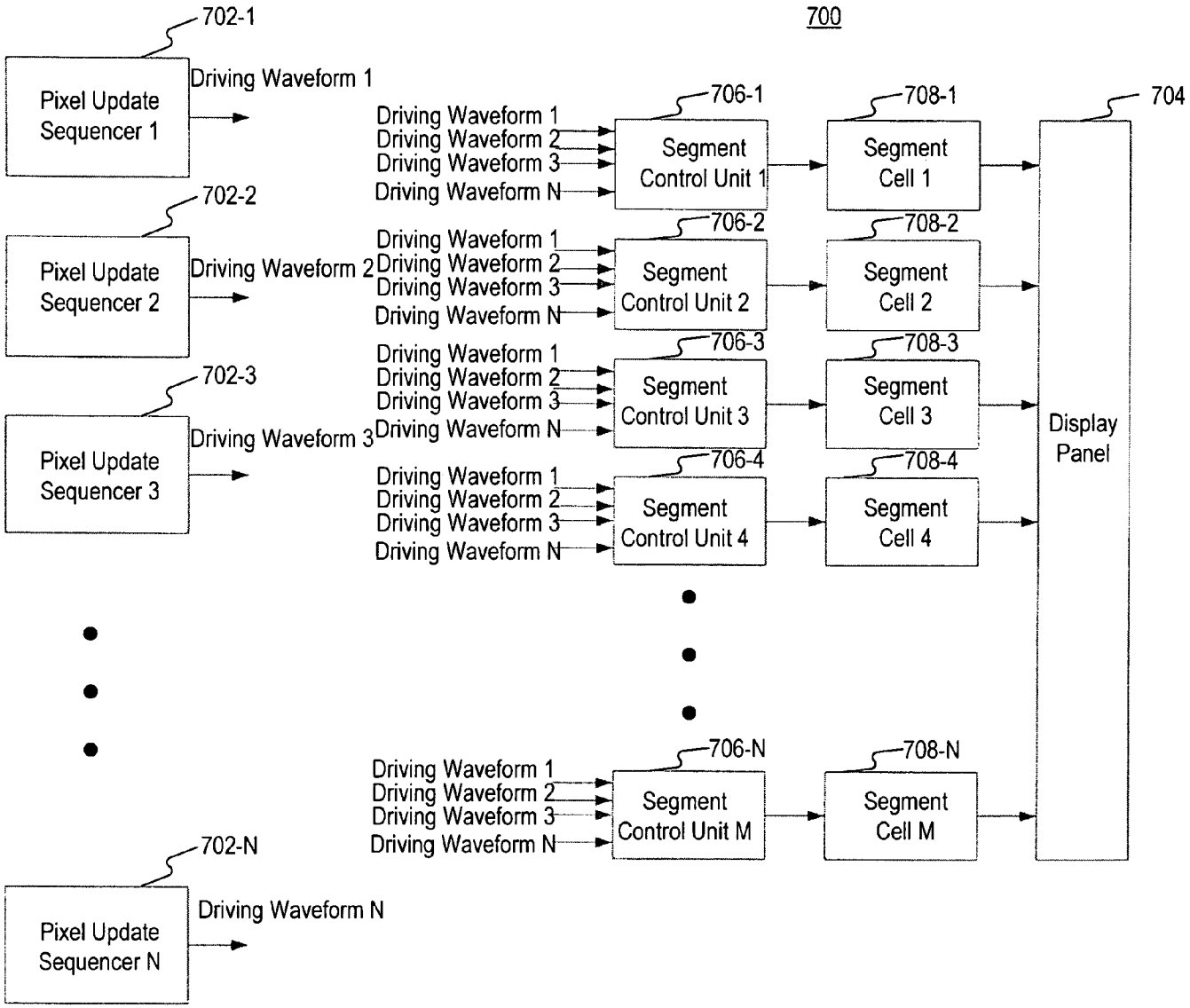
FIG. 7 illustrates a block diagram of a driving display system consistent with an embodiment of the present invention.

FIG. 7 illustrates a display driving system 700 for driving a bistable display panel, consistent with an embodiment of the present invention. For example and without limitation, system 700 is described with respect to driving an EPD panel. However, system 700 may be applied with equal effectiveness to drive other types of bistable displays.

System 700 includes pixel update sequencers 702-1, 702-2, . . . , 702-N, each of which is configured to generate time-independent waveforms for driving pixels of an EPD panel 704. In the present embodiment, sequencers 702-1, 702-2, . . . , 702-N respectively generate time-independent driving waveforms 1, 2, . . . , N. System 700 also includes segment control units 706-1, 706-2, . . . , 706-*m* each of which is coupled to receive all of driving waveforms 1, 2, . . . , N. System 700 further includes segment cells 708-1, 708-2, . . . , 708-*m*, respectively coupled to receive outputs from segment control units 706-1, 706-2, . . . , 706-*m*. The respective outputs of segment cells 708-1, 708-2, . . . , 708-*m* are applied to drive panel 704. Each segment cell 708-1, 708-2, . . . 708-*m* is coupled to drive a single segment of panel 704. In the present embodiment, each segment corresponds to a single pixel. Each of segment control units 706-1, 706-2, . . . , 706-*m* is adapted to select one of the waveforms 1, 2, . . . , N applied thereto. Each of the segment cells 708-1, 708-2, . . . , 708-*m* receives the selected waveform output by its associated segment control unit 706-1, 706-2, . . . , 706-*m*, respectively and converts the output waveform to an analog drive signal in order to drive the EPD panel.

Figure 8:
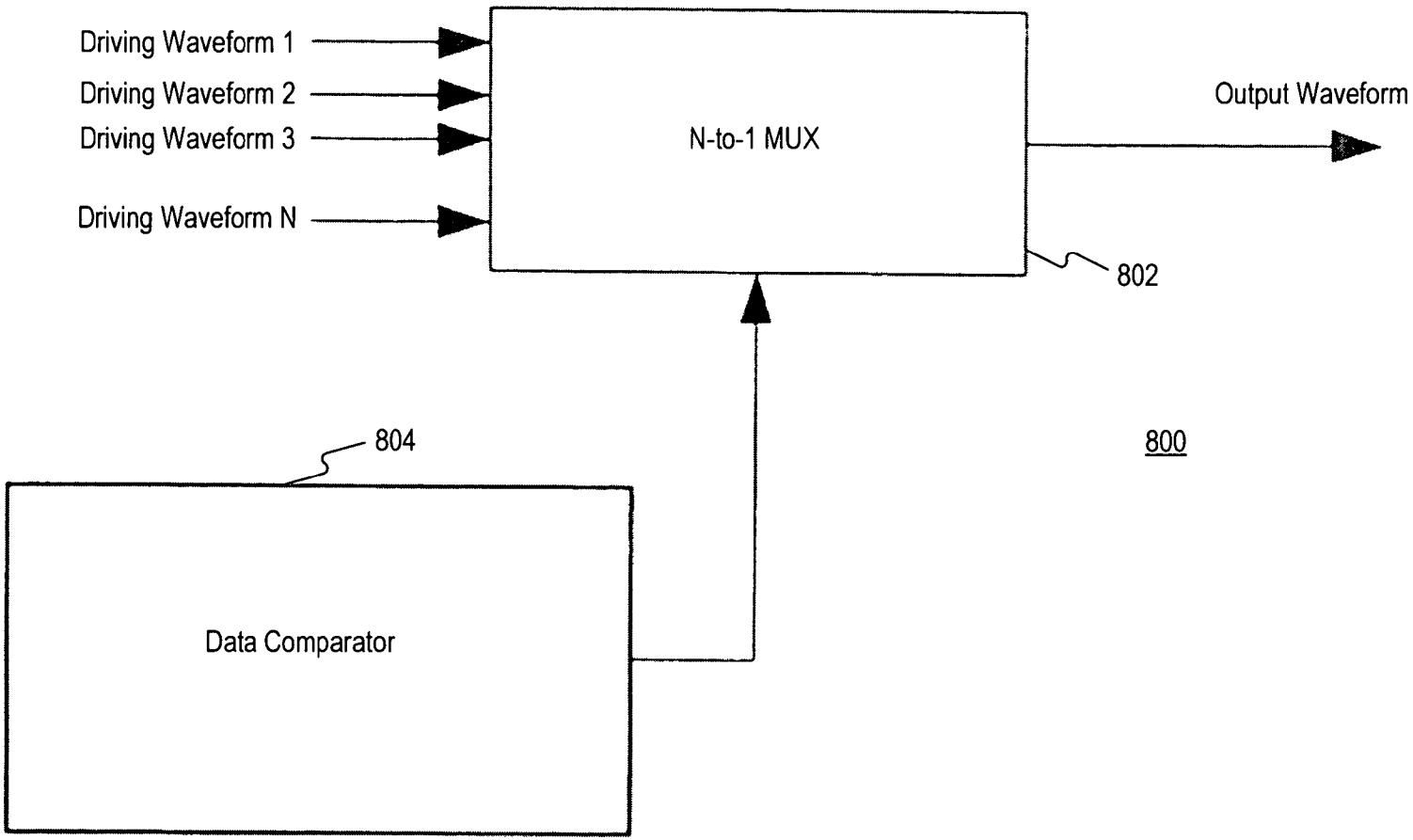
FIG. 8 illustrates a segment control unit shown in FIG. 7.

FIG. 8 illustrates an exemplary segment control unit 800 corresponding to any one of units 706-1, 706-2, . . . , 706-*m*. Unit 800 comprises an N-to-1 multiplexer (MUX) 802, which is used to select one of the driving waveforms 1, 2, . . . , N as an output waveform for outputting to the associated segment cell. Segment control unit 800 also includes a data comparator 804 which outputs a control signal to determine any change in a drive waveform, by comparing previous data with updated data.

Based on properties of the EPD panel, only an updated waveform is applied to changed segments. For unchanged segments, there is no need to apply any waveform since the panel will remain unchanged. Also, an unbalance may result if unchanged segments are driven by the same waveform. Such an unbalance may reduce the life of the panel.

Changes in display data are provided as input to one or more of sequencers 702-1, 702-2, . . . , from circuitry and/or software and/or a communication link, not shown, corresponding to an application that determines the nature of the displayed data.

For example, when there is only a change in data for a particular segment e.g., segment 1, only this segment will have an updated waveform, while others remain unchanged. One of the sequencers 702-1, 702-2, . . . , 702-N, is used to drive the required waveform. The corresponding segment control unit will detect a change in the data and in turn, select the required waveform for output to the corresponding segment cell.

If there is a change in data for another segment, e.g., a second segment, during the drive period of a first segment, the other segments remain unchanged. According to the properties of bistable panels, including EPD panels, only the changed segments need to be updated. Hence, another sequencer, e.g., sequencer 702-2, may be used to output another independent driving waveform to the second segment, i.e., driven by segment cell 708-2. This process can be repeated until all the sequencers 702-1, 702-2, . . . , 702-N are used.

Figure 9:
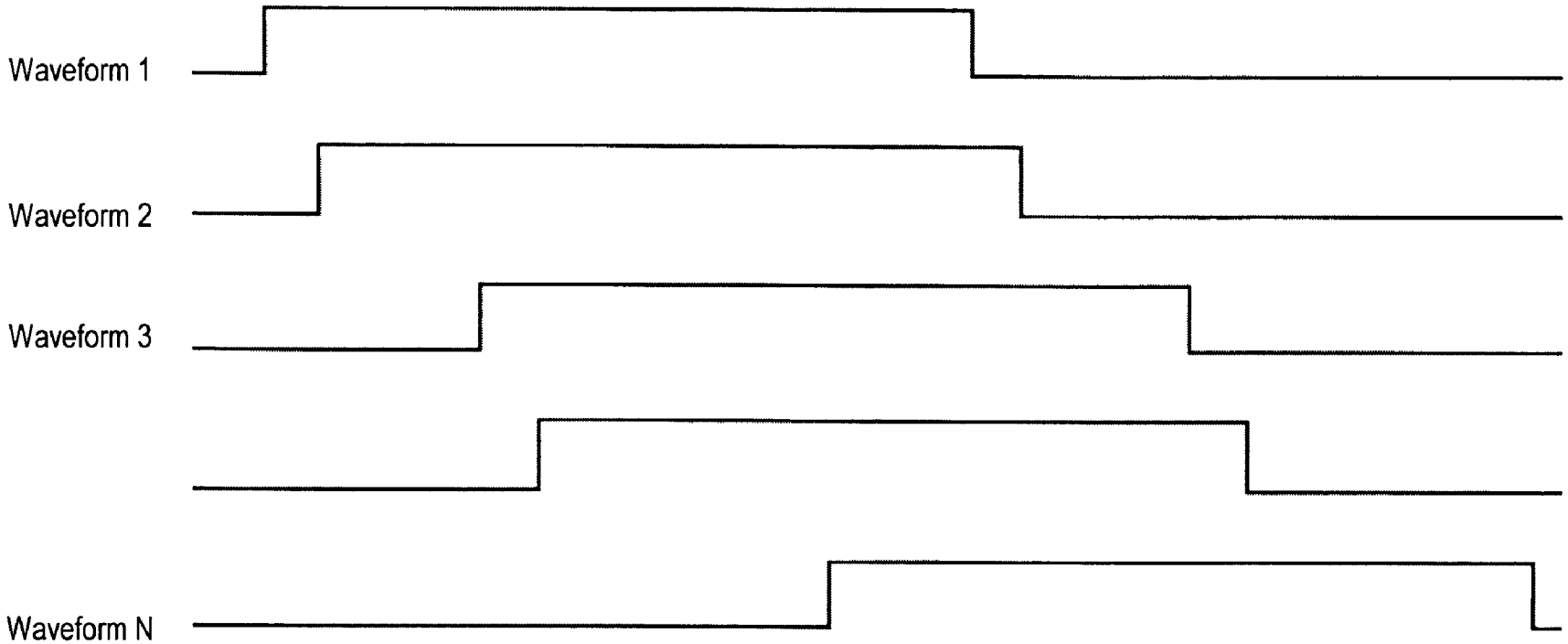
FIG. 9 illustrates driving waveform output consistent with an embodiment of the present invention.

In system 700 having N pixel update sequencers, there can be, at most, N different independent driving waveforms at the same time. Also, each segment cell can receive any of the N waveforms and start the updating process instantly when an update is received. FIG. 9 illustrates driving waveforms 1, 2, . . . , N, output by sequencers 702-1, 702-2, . . . , 702-N, respectively, generated as updates occur. Hence, update speed of the EPD panel is improved in a real time application as shown in FIG. 9.

Provision of N-to-1 MUX 802 in each segment control unit 800 of the present embodiment enables the number of waveform generators N to be much less than the number of segment cells M. In the present embodiment, the number M of segment cells is determined by the number of pixels in the panel. If there are M pixels in the panel, there are M segment cells in system 700. While the number of waveform generators N can be different among applications, the system 700 can be configured to be useful and cost effective based on a condition where N<<M and N is a small number while M is large number, e.g., N=7, M=90.

An update of an image requires a waveform to implement the update. For example, when using a mobile phone with a bistable display, such as an EPD, an input from the keyboard leads to an update on the display. A sequence of inputs leads to a sequence of updates for the display. If all waveform generators are occupied in updating the current display, the following input must wait until a previous update is completed. The more waveform generators, the more inputs that can be responded to and displayed instantly.

However, if N is too large, the cost to implement the pixel update sequencers and the segment control units to select the driving waveform is very high due, for example, to greater circuit area. On the other hand, if M is too small, such that the number of sequencers N is the same as the number of segment cells M (e.g., N=10, M=10), every pixel is driven by a separate waveform generator and can be updated immediately. This results in the above described conventional techniques, which is undesirable for the reasons previously discussed.

The number of waveform generators N is also related to the time length of the waveform and the user interface. Typically, depending on the possibility of how many inputs may occur in a period of image response time, the number of waveform generators N can be far less than that of segment cells M. For example, assuming T is the period of the longest driving waveform and $t_R$ is the response time of a user or an external response to update the next segment, the following relationship is descriptive:

$$\frac{T}{t_R} \leq N.$$

For example, in one case, when N=7, T=1 s, and $t_R$=0.5 s, which represent typical requirements for a bistable display, such as an EPD, in mobile phone display applications when the above condition are fulfilled. Therefore, for example, the capability to drive EPD panel 704 in accordance with the present embodiment is determined by each pixel response time, and does not depend on any segment cell hardware design because each segment cell output is independently driven. Also, the display driving system and method of the present embodiment provide flexibility for programmers or users to program and control each segment output at different times.

The arrangements described are applicable to driving a bistable display, more particularly to substantially decrease display response time of the bistable display by providing multiple independent waveforms at the same time and segment control units to select the waveforms to display different patterns. The disclosed arrangements can be implemented in driver circuits for a bistable display, including an EPD.

The foregoing description is intended to illustrate but not to limit the scope of the invention, which is defined by the scope of the appended claims. Other embodiments are within the scope of the following claims.

What is claimed is:

1. A method for driving segments of a bistable display, the method comprising:

generating, by a plurality of generating units, a plurality of independent waveforms corresponding to changes in display data for driving a plurality of segments of the bistable display;

receiving each of the waveforms generated by the plurality of generating units at each of a plurality of segment control units;

selecting and initiating, for each segment independently, one of the independent waveforms;

determining whether an update of display data has occurred for one of the segments;

selecting a different one, or a different sequence of, the waveforms corresponding to a change of display data for the one of the segments, to drive the segment if an update has occurred; and maintaining a currently selected waveform to drive the segment if an update has not occurred, wherein the independent waveforms are generated by different generating units and initiated independently in time; and wherein the waveforms are generated based on a number of the segments, durations of the waveforms, and an update frequency of the bistable display, wherein a first independent waveform having a longer duration is greater in quantity than a second independent waveform having a shorter duration.

2. The method of claim 1, wherein updating of subsequent segments is initiated at predetermined times.

3. The method of claim 2, wherein updating of subsequent segments is initiated in response to an application input of an individual segment, independently among the segments.

4. The method of claim 1, wherein the independent waveforms are identical in form.

5. The method of claim 1, wherein the bistable display is an electrophoretic display panel (EPD);

the providing step including providing the plurality of waveforms to the EPD.

6. The method of claim 1, wherein an update to a first segment begins while an update to a second segment is performing.

7. A system for driving segments of a bistable display, the system comprising:

a plurality of segment cells coupled to drive corresponding segments of the bistable display;

a plurality of generating units for generating time-independent waveforms corresponding to changes in display data for provision to the plurality of segment cells; and a plurality of segment control units coupled to each of the generating units for receiving each of the time-independent waveforms generated by each of the plurality of generating units for selecting one of, or a sequence of, the waveforms for output to the corresponding segment cells, corresponding to a change in display data for the segments;

each of the segment control units including means for determining whether display data for the corresponding segment cell has changed and for selecting the waveform from a different one of the generating units if the display data has changed or maintaining output of a current one of the waveforms in response to a determination that no update has occurred, wherein the time-independent waveforms are generated by different generating units and initiated independently in time; and wherein a number of the time-independent waveforms from the generating units is determined based on a number of the segment cells, durations of the time-independent waveforms, and an update frequency of the bistable display, wherein a first time-independent waveform having a longer duration is greater in quantity than a second time-independent waveform having a shorter duration.

8. The system of claim 7, wherein each of the plurality of segment cells converts an output waveform from the corresponding segment control unit to an analog drive signal for driving the corresponding segment of the bistable display.

9. The system of claim 7, wherein the segment control units comprise a multiplexer for selecting one of the waveforms provided to the corresponding segment cell.

10. The system of claim 7, wherein the means for determining comprises a change in the display data by comparing previous data with updated data.

11. The system of claim 7, wherein the bistable display is an electrophoretic display.

12. The system of claim 7, wherein an update to a first segment begins while an update to a second segment is performing.

* * * * *